United States Patent [19]

Sachs et al.

[11] 4,196,243

[45] Apr. 1, 1980

[54] NON-SKID FLOOR COVERING

[75] Inventors: Peter R. Sachs, New Windsor; George Thomas, Newburgh, both of N.Y.

[73] Assignee: GAF Corporation, New York, N.Y.

[21] Appl. No.: 946,941

[22] Filed: Sep. 29, 1978

[51] Int. Cl.[2] ..... D06N 7/04; B32B 27/40

[52] U.S. Cl. ..... 428/147; 427/54.1; 427/180; 427/289; 427/293; 427/372.2; 428/161; 428/172; 428/327; 428/424.6; 428/206; 428/520; 428/522; 428/443; 428/47; 428/48

[58] Field of Search ..... 428/327, 443, 425, 206, 428/47, 48, 520, 522, 206, 161, 147; 427/54, 293, 180, 372 R, 289

[56] References Cited

U.S. PATENT DOCUMENTS

| | | | |
|---|---|---|---|
| 3,450,563 | 6/1969 | Krueger | 428/327 |
| 3,666,521 | 5/1972 | Weyna | 428/451 |
| 3,679,539 | 7/1972 | Gossens | 428/149 |
| 3,878,133 | 4/1975 | Rubens | 428/327 |
| 3,924,023 | 12/1975 | Boranian | 428/334 |
| 3,991,006 | 11/1976 | Chandler | 260/42.43 |
| 4,038,453 | 7/1977 | Loran | 428/327 |
| 4,087,400 | 5/1978 | Skinner | 428/425 |
| 4,115,472 | 9/1978 | Porter | 428/425 |

*Primary Examiner*—Ellis P. Robinson

*Attorney, Agent, or Firm*—Walter C. Kehm; Joshua J. Ward

[57] ABSTRACT

Non-skid floor covering having a plastics wear layer over a vinyl substrate. The wear layer has dispersed therein between about 20 and about 40 wt % particulate plastics material in the size range between about 200 mesh and about 1/16 inch. The particulate material has a hardness of not more than Rockwell M-100 and a Taber abrasion weight loss of not more than about 75 mg per 1000 cycles using CS-17 wheels and 1000 g weights.

7 Claims, No Drawings

NON-SKID FLOOR COVERING

BACKGROUND OF THE INVENTION

In the manufacture of floor coverings such as floor tiles, flexible sheet vinyl, etc., it is sometimes desirable, especially in the manufacture of vinyl floor tiles, to provide such material with non-skid wear layers. Conventional non-skid tile is made by heating individual pieces of ordinary vinyl tile, sprinkling the surface with carborundum grit and then embedding the grit into the surface of the tile with a hand operated platen press. This can not be done on a production line basis because the hard abrasive grit would destroy the accuracy of the cutting dies used to cut individual tiles from the sheet of tile material. While sheet vinyl flooring having particulate matter protruding from the surface thereof has been manufactured, the particles used have been so soft that they have not been effective in providing a non-skid surface.

SUMMARY OF THE INVENTION

Non-skid floor covering is provided which has a plastics wear layer over a vinyl substrate. The wear layer has uniformly dispersed therein between about 20 and about 40 wt % based on total wear layer of particulate plastics material in the size range between about 200 mesh and about 1/16 inch with such plastics material having a hardness of not more than about Rockwell M-100 and a Taber abrasion weight loss of not more than about 75 mg per 1000 cycles using CS-17 wheels and 1000 g weights. The surface of the wear layer has a height variation of at least about 5 mils due to the presence of the particulate material. In a preferred embodiment the wear layer is a urethane wear layer. Substrates are preferably conventional vinyl tile base material or conventional PVC plastisol or organosol layers such as are commonly used in sheet vinyl floor coverings.

The process of the invention includes first forming a vinyl substrate and then coating the substrate with fluid wear layer coating having slurried therein between about 20 and about 40 wt % based on total coating of particulate plastics material in the size range between about 200 mesh and about 1/16 inch. The particulate material must have a hardness of not more than about Rockwell M 100 and a Taber abrasion weight loss of not more than about 75 mg per 1000 cycles using CS-17 wheels and 1000 gram weights. The coating is then cured to form a cured wear layer having the particulate material dispersed therein with the surface of the wear layer having a height variation of at least about 5 mils due to the presence of the particulate material. A preferred embodiment involves the manufacture of viny floor tile in a continuous process with the use of urethane coating material cured by exposure to ultraviolet (UV) light.

DETAILED DESCRIPTION OF THE INVENTION

As mentioned above, the product of the invention is non-skid floor covering having a plastic wear layer over a vinyl substrate. Non-skid floor covering contemplated by the invention includes a variety of covering materials such as sheet vinyl flooring, vinyl floor tiles, etc. Suitable sustrates may therefore include such conventional substrates as vinyl tile base, polyvinyl chloride (PVC), plastisol or organosol layers as commonly used in sheet vinyl flooring, etc. The substrate which forms a component of the invention, especially where such substrate is a PVC layer in flexible sheet vinyl flooring, may of course be further supported by other layers and substrates in a conventional manner. PVC layers used as substrates in products of the invention may for instance be further supported on suitable supporting materials such as asbestos sheet, woven or non-woven fibrous web, other plastisol layers, plastisol on felt backing, etc. PVC layers suitable for substrates of the present invention may be foamed or unfoamed and may be of any of the various PVC resin materials normally used in connection with coating of decorative sheet materials. Such substrates may include, but are not limited to the PVC plastics materials described in U.S. Pat. No. 3,458,337, and U.S. Pat. No. 3,293,094, the disclosures of which are incorporated herein by reference. It should be understood that where appropriate, a substrate of the invention may include such a PVC layer having printing or other decorative effects superimposed thereon.

In a preferred embodiment product of the invention is vinyl floor tile and the substrate is vinyl tile base comprising vinyl chloride polymer, filler and plasticizer. Such tile base may include other conventional ingredients such as pigment, light and heat stabilizers, etc. Vinyl tile base as described in U.S. Pat. Nos. 3,991,006 or 3,924,023, the disclosures of which are incorporated herein by reference, is for instance suitable for use in products of the invention. The tile base may also include decorative chips such as mottle or solid color chips either calendered into the surface of the tile base or present throughout the tile base, all in a conventional manner.

The wear layer of products of the invention may be of any suitable material with conventional PVC organosol or plastisol wear layers and urethane wear layers being preferred. A particularly preferred wear layer material for use on floor tiles is one which comprises urethane compound photopolymerized by exposure to ultraviolet light from a fluid coating composition comprising urethane compound having at least two photopolymerizable ethylenically unsaturated groups of the general formula:

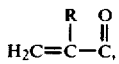

where R is either H or $CH_3$. Such wear layers are described in greater detail in the above mentioned U.S. Pat. No. 3,924,023.

As mentioned above, wear layers of products of the invention have dispersed therein between about 20 and about 40 wt % based on total wear layer of particulate plastics material in the size range between about 200 mesh and about 1/16 inch with such material having a hardness of not more than about Rockwell M-100 and a Taber abrasion weight loss of not more than about 75 mg. The use of such amounts of material meeting the above-mentioned hardness and abrasion requirements is essential to obtaining a good non-skid wear layer on the products of the invention. Particles of greater hardness create problems in excessive wear of the dies used to cut individual tiles during manufacture while particulate material which abrades to easily will not provide satisfactory service for a non-skid floor surface. As mentioned, material having a Taber abrasion weight loss of not more than about 75 mg is required; however, material having a Taber abrasion weight loss not exceeding about 50 mg is preferred. With regard to size of the particles of plastic material dispersed in the wear layer, material smaller than 200 mesh (i.e. which will pass through a 200 mesh sieve) will not generally provide sufficient resistance to skidding while material in excess of about 1/16 inch particle size tends to be so large as to break loose easily from the coating and to provide an unduly rough surface for most applications. In order to provide a suitable non-skid surface, the upper surface of the wear layer of product of the invention should have a height variation due to the presence of the particulate material of at least about 5 mils.

Preferred urethane coating compositions used for the product and process of the invention are urethane-type compounds having two or more photo-polymerizable ethylenically unsaturated groups of the general structure:

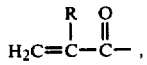

where R is either H or $CH_3$. Such urethane-type compounds have the general molecular configuration.

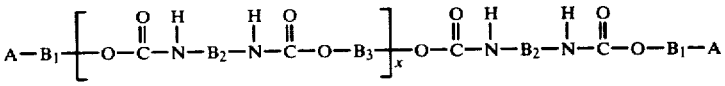

wherein A is either

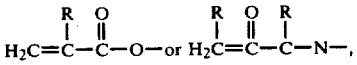

R being H or $CH_3$; x is 0, 1 or 2; and $B_1$, $B_2$ and $B_3$ are each taken from the group consisting of an alkylene of the type

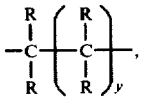

where R is H, $CH_3$ or $C_2H_5$ and y is either 0 to 1 to 6, cycloalkylene of the type

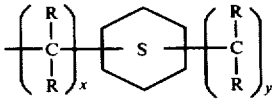

wherein R is H, $CH_3$ or $C_2H_5$, x=0 or 1 or 2 and y=0 or 1 or 2, oxyalkylene of the type

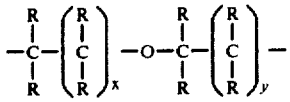

wherein R is H, $CH_3$ or $C_2H_5$, and x or y or both either 1, 2 or 3;

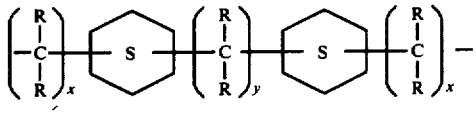

where R is H, $CH_3$ or $C_2H_5$, y is 0, 1, 2 or 3, and x is 0, 1 or 2; and

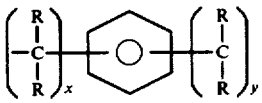

wherein R is H, $CH_3$ or $C_2H_5$, and x y are both either 1 or 2. It will be appreciated that x and y may constitute a mixture of the values indicated herein.

Such coatings having urethane linkages therein may be prepared by conventional methods well known in the art. As the coating compositions per se are not the point of novelty of the present invention, details concerning the preparation of such coatings are not included herein, the preparation of such compounds generally being within the skill of the art. With regard to coatings of the type indicated above, however, it might be noted that one mole of dihydric alcohol may be reacted with two moles of disocyanate, followed by reaction of the product thereof with two moles of hydroxyethylacrylate. This well known operation is facilitated by the use of a basic catalyst, such as stannous octoate, dibutyl tine dilaurate or the like, in amounts of generally from about 0.05% to about 0.1% by weight of the total system, the operation being complete in a few hours at reaction temperatures of on the order of 50° C. as is well known in the art. Illustrative examples of said photo-polymerizable compounds of the type indicated are:

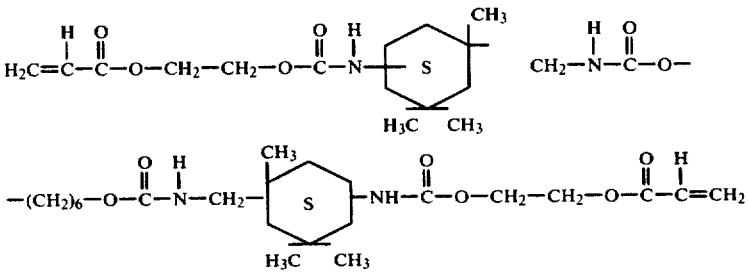

AND

-continued

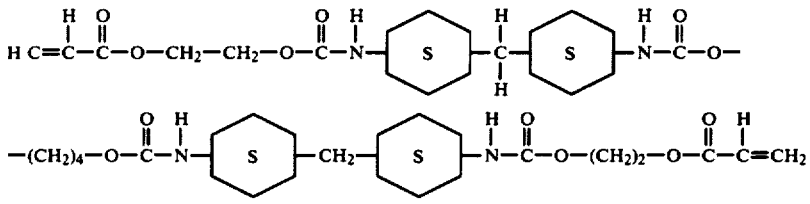

It will also be appreciated that compounds of a tri-functional photo-polymerizable nature can readily be produced and would be of interest with respect to the present invention.

It will be appreciated that the viscosity of the UV curable urethane coating described above for use in connection with the process and product of the invention may vary widely depending upon the particular coating technique employed. For instance, in a preferred embodiment of the invention in which the coating is applied to the vinyl sheet by conventional roll coating techniques, the viscosity of the coating is preferably between about 1,000 and about 3,000 centiposes (cp) at 77° F. Roll coating is a preferred technique for applying the urethane coating containing the particulate material.

In order to achieve satisfactory continuous operation over substantial periods of time using urethane coating material cured by on line exposure to ultraviolet light, it is essential that the percent volatility of the urethane coating as applied to the substrate in accordance with the invention be less than about 2 percent, preferably less than about 1 percent, such as between about 0.05 and about 1.0 percent. As used herein, the term "percent volatility" means the weight percent (wt %) of the total fluid coating which is removed from the coating mixture by heating in an oven with full air circulation for 5 minutes at 82° C. If the volatility of the coating composition exceeds the limits stated herein, it has been found that continuous operation of the process of the invention for more than an hour or two is not possible. If the volatility does not exceed about 1.0 percent, continuous operation may be substained almost indefinitely. It has been found, for instance, that the quartz tubes of UV lamps tend to blacken after an hour or so of continuous operation if volatility of the coating composition is above the levels specified herein. This results in inadequate curing of the urethane coating and a resulting tile product having a coating with inadequate resistance to scratching. For off line coating, volatility is not considered critical.

In accordance with customary practice, UV curable urethane coating compositions applied to the substrate will advantageously contain a conventional amount of known photo-sensitizers. Such photo-sensitizers or photoinitiators absorb ultraviolet light resulting in the formation of free radicals capable of initiating polymerization. Illustrative of such photo-sensitizers are sulfur-containing compounds, such as dithiocarbamates, trithiocarbonates, thiuram compounds, thiazoles and xanthates, as well as aromatic disulphides, phenylacetophenone derivatives, e.g., benzil and benzoin, and benzoin ethers, such as benzoin-methyl, -ethyl, -n-propyl and -isopropyl ethers. Such photo-sensitizers are generally employed in amounts from about 0.5% to about 5%, commonly from about 1% to about 2% by weight of the coating composition. The amount and type of photo-sensitizers, free radical generating under ultraviolet radiation, employed in the practice of the invention will be selected, of course, to be compatible with the particular polymeric system utilized. It will also be appreciated that the particular photo-sensitizers employed in any given application must also be sensitive to the wavelengths and energy level of the ultraviolet light source with which it is employed in the given application in order to initiate the desired reaction and thus effect the curing of the coating on the vinyl asbestos sheet.

Additional conventional ingredients of reactive UV curable urethane coatings which may be present in the coatings of the present invention include pigments, fillers, dyes, thermoplastic additives such as cellulose acetate butyrate, plasticizers, synthetic resins, heat and light stabilizers, filler such as carbon black, glass fibers, silica, etc.

UV curable coating compositions for use in the invention will also preferably contain one or more mono or di-functional vinyl monomers copolymerizable under ultraviolet radiation with the above-indicated urethane compounds used in the coating composition. The monomer functions to reduce the viscosity of the urethane compound that may otherwise be too viscous to apply to the continuous sheet of vinyl material passing the coating zone of the production line. The monomers are preferably of a suitably low vapor pressure to prevent evaporative loss during application and curing. The monomers must also be sufficiently stable to prevent premature gelation or reaction with the urethane compounds employed in the coating composition prior to exposure of the coating to ultraviolet light in the irradiation zone of the vinyl tile producing operations of the invention. If desired, small amounts of polymerization inhibitors may be added to the coating for this purpose. Illustrative of the numerous mono-functional monomers that are suitable for use in the invention are acrylates or methacrylates having the formula:

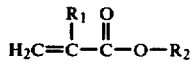

wherein $R_1$ is H or $CH_3$ and $R_2$ is an alkyl or cycloalkyl group having 6 to 18 carbon atoms, a phenoxyalkyl group of 6 to 18 carbon atoms, or a hydroxyalkyl group. In this regard, it will be appreciated that certain limited amounts of hydrophilic monomers, such as hydroxyethyl acrylate or N-vinyl pyrrolidone, may be present in the overall coating composition without adversely affecting the properties of the cured wear layer coating so long as the amount is not such as to introduce undesired water sensitivity to the coating. Other representative examples of the numerous mono-functional monomers of the type indicated that are suitable for use in the invention are lauryl methacrylate, isodecyl acrylate, cyclohexyl acrylate and 2-phenoxyethyl acrylate. Styrene may be employed, but is generally not preferred because of a potential to discolor upon long time exposure to light in service. Suitable difunctional monomers include, for instance, hexanediol diacrylate, butanediol diacrylate, diethyleneglycol diacrylate, triethyleneglycol diacrylate, tetraethylenglycol diacrylate, etc. Small amounts of styrene or vinyl toluene can be tolerated, however, as can small amounts, generally from about 1-2% up to about 5% by weight, of other monomeric materials, e.g., trimethylolpropane triacrylate. The amount of vinyl monomer employed for the indicated purpose will vary depending on the characteristics of the urethane compound of the coating. While the monomer content will generally range from about 15% up to about 45% by weight.

Thicknesses of substrates and wear layers of materials of the invention may of course vary widely depending upon the particular materials employed and the nature of the end product. For instance, PVC layers of sheet vinyl flooring material which serve as substrates for products of the invention frequently vary in thickness between about 4 and about 12 mils with total thickness of the sheet vinyl product including any other layers, substrates, etc. varying between about 50 and about 250 mils. The wear layer itself frequently varies in thickness between about 1 and about 10 mils with relatively thicker wear layers, e.g. between about 4 and about 10 mils being used where the wear layer is formed of PVC and relatively thinner wear layers, e.g., 1-5 mils thick preferably being used where the wear layer is a urethane based material. It is understood that the preferred thickness of urethane wear layer does not necessarily include additional thickness caused by the presence of the non-skid plastic particles dispersed in the wear layer. It is, however, preferred that the thickness of urethane itself at any one point, e.g. over plastics particles (or where plastics particles are not present at a particular location, the total thickness of the wear layer) not exceed about 5 mils. This is especially true where the wear layer is cured by exposure to ultra-violet light.

It will be understood that a wide variety of various types of materials are satisfactory for use as particulate plastics material in wear layers of products of the invention providing the size, hardness and abrasion characteristics described above are met. Suitable plastics materials include for instance polystyrene, various acrylics, e.g. polymethylmethacrylate, polycarbonates, styrene-acrylonitrile copolymers, polybutylene terephthalate, polyethylene terephthalate, polypropylene, etc. Though not essential, it is highly preferred that the plastics material used be capable of being recycled during manufacture of the flooring material. Further, the material used should not be so soluble in the coating material as applied during manufacture that the discrete nature of the particles is destroyed. The plastics material used is also preferably in the form of particles having irregularly shaped surfaces with relatively sharp edges so as to enhance the non-skid effect. Such particles may be made, for instance, by first forming a sheet of the desired material and then breaking the sheet into particles of the desired size range of between about 200 mesh and about 1/16 inch.

As mentioned above, the process of the invention involves coating vinyl substrate with a fluid wear layer of coating having slurried therein particulate plastics material of the type described above.

The substrates may be formed in a suitable manner as described for instance in the U.S. patents mentioned above. Slurries of fluid coating material containing particulate plastics material in accordance with the invention may of course be formed in any suitable manner using conventional slurrying equipment. Application of slurries containing particulate plastics material to the substrate in accordance with the invention may be by any suitable coating technique such as spraying, knife coating or roll coating, with roll coating being preferred.

Curing of wear layers in the practice of the invention may be carried out in any manner suitable to the curing of the type of coating used. PVC coatings will normally be cured by exposure to heat. Urethane coatings will be cured by curing techniques appropriate to the particular type of coating used. In the preferred embodiment in which the preferred urethane coatings mentioned above are used in the manufacture of non-skid floor tile, the curing will preferably be by exposure to ultra-violet light in the manner taught for instance in the above mentioned U.S. Pat. No. 3,924,023.

Other steps in the manufacture of product of the invention by the process of the invention may be in accordance with conventional manufacturing techniques for the type of product involved. Sheet vinyl flooring material may for instance be manufactured in accordance with generally accepted procedures. Floor tile likewise may be manufactured in accordance with generally accepted procedures with the coating of the tile base and subsequent curing of the coated tile taking place either before or after individual tiles are cut from the sheet of tile base material. In the preferred embodiment mentioned above in which vinyl floor tile base is roll coated with a slurry of particulate plastics material in UV curable fluid coating which is subsequently cured by exposure to ultra-violet light, the entire manufacturing operation is preferably carried out on a continuous basis as taught for instance in the above mentioned U.S. Pat. No. 3,924,023; it being understood, however, that printing as required by the disclosure and claims in that patent is optional for purposes of the present invention.

The following example is intended to provide an illustrative embodiment of the invention without limiting the scope thereof.

EXAMPLE

A floor tile formulation was prepared from the following ingredients:

| Ingredient | Parts by Wt. |
|---|---|
| Vinyl chloride - vinyl/acetate Copolymer | 18 |
| Butyl benzyl phthalate | 9 |
| Dicyandiamide | 1 |
| Asbestos | 15 |
| 40 Mesh Limestone | 57 |

The above mixture was blended in a Baker-Perkins mixer and then milled and calendered to produce a sheet of tile base material 1/16 inch thick from which individual tiles were cut. The individual tiles were then coated to a thickness of 2-3 mils with a slurry of 20 wt% solid polypropylene particles in a urethane coating composition. The coating composition was a fluid oligomeric urethane terminated by acrylate groups dissolved in a mixture of acrylates containing photoinitiator. The polypropylene particles averaged about 200 microns diameter with a size range between about 100 and about 300 microns. The original viscosity of the urethane coating precursor before addition of the polypropylene was 2000 cps. Addition of the polypropylene particles increased the viscosity of the total coating composition to about 4000–5000 cps. The coating slurry was then applied to individual tiles to a thickness of about 3 mils using a roll coater and was cured by exposure to ultra-violet radiation in the range of 200–400 nanometers. This was accomplished by exposure for a period of 1 second to medium pressure mercury UV lamps providing a total of about 500 watts per square foot of UV radiation to the coated surface of the tile. The resulting tile was considered entirely satisfactory as a non-skid tile, and the upper surface of the wear layer had a height variation of 5–8 mils due to the presence of the polypropylene particles in the wear layer.

While the invention has been described above with respect to certain embodiments thereof, it will be appreciated that various changes and modifications may be made without departing from the spirit or scope of the invention.

What is claimed is:

1. Non-skid floor covering having a plastics wear layer over a vinyl substrate, said wear layer comprising urethane compound photopolymerized by exposure to ultraviolet light from a fluid coating composition comprising urethane compound having at least two photopolymerizable ethylenically unsaturated groups of the general formula:

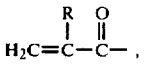

where R is either H or $CH_3$ and said wear layer having uniformly dispersed therein between about 20 and about 40 wt% based on total wear layer of particulate plastics material in the size range between about 200 mesh and about 1/16 inch, said plastics material having a hardness of not more than Rockwell M-100 and a Taber abrasion weight loss of not more than about 75 mg per 1000 cycles using CS-17 wheels and 1000 gram weights and the surface of the wear layer having a height variation of at least about 5 mils due to the presence of the particulate material.

2. Floor covering according to claim 1 in the form of floor tiles and wherein the substrate is tile base comprising filler, vinyl chloride polymer and plasticizer.

3. Floor covering according to claim 1 in the form of sheet type covering material in which the substrate comprises cured polyvinyl chloride plastisol or organosol.

4. Process for making non-skid floor covering comprising:

(a) first forming a vinyl substrate;

(b) then coating said substrate with fluid wear layer coating, said coating comprising urethane compound having at least two photopolymerizable ehtylenically unsaturated groups of the general formula:

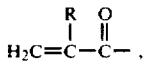

where R is either H or $CH_3$, said wear layer coating having slurried therein between about 20 and about 40 wt% based on total coating of particulate plastics material in the size range between about 200 mesh and about 1/16 inch, said plastics material having a hardness not more than about Rockwell M-100 and a Taber abrasion weight loss of not more than about 75 mg per 1000 cycles using CS-17 wheels and 1000 gram weights; and (c) then curing said coating to form a cured wear layer having a height variation of at least about 5 mils due to the presence of the particulate material.

5. Method according to claim 4 wherein the floor covering is floor tile and the substrate is a sheet of tile base comprising a uniform mix of filler, vinyl chloride, polymer and plasticizer.

6. Method according to claim 4 wherein the floor covering is sheet type flexible floor covering and the substrate comprises a layer of gelled or cured PVC plastisol or organosol.

7. Method according to claim 4 wherein:

(a) the substrate is formed by continuously calendering a uniform mix comprising filler, vinyl chloride polymer and plasticizer to form a continuous vinyl sheet having a thickness of from about 1/16 inch to about ⅛ inch, said continuous sheet being discharged from the calendering zone at a travel rate of at least about 80 ft./min;

(b) coating the thus formed continuous vinyl sheet at a travel rate of at least about 80 ft./min. with said fluid coating composition, said fluid coating composition comprising urethane compound having at least two photopolymerizable ethylenically unsaturated groups of the general structure.

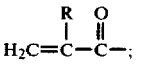

where R is either H or $CH_3$.

(c) exposing the thus coated sheet traveling at at least about 80 ft./min. to ultraviolet light at a temperature of from about 110° F. to about 220° F. and at a radiation intensity level sufficient to initiate desired curing of the coating within an ultraviolet exposure time of from 0.2 seconds to about 15 seconds; and (d) passing the thus treated sheet to a cutting zone and therein cutting the sheet to form individual tiles having non-skid wear layer thereon.

* * * * *